US005632633A

United States Patent [19]

Roosdorp et al.

[11] Patent Number: 5,632,633

[45] Date of Patent: May 27, 1997

[54] METHOD OF MANUFACTURING A GROUNDING CONNECTOR AND IMPROVED GROUNDING CONNECTOR

[75] Inventors: Joannes W. M. Roosdorp, Penha-Braganca Paulista-SP; Wilson M. Yamada, Vila Aparecida-Braganca Paulista-SP; Alexandre M. Soriano, Pedra Bela-SP-Cep, all of Brazil

[73] Assignee: The Whitaker Corporation, Wilmington, Del.

[21] Appl. No.: 695,545

[22] Filed: Aug. 12, 1996

Related U.S. Application Data

[63] Continuation of Ser. No. 363,097, Dec. 22, 1994, abandoned.

[30] Foreign Application Priority Data

Jan. 17, 1994 [BR] Brazil ..... 9400114-6

[51] Int. Cl.$^6$ ..... H01R 4/50

[52] U.S. Cl. ..... 439/100; 439/807; 439/863

[58] Field of Search ..... 439/807, 100, 439/791, 783, 863

[56] References Cited

U.S. PATENT DOCUMENTS

| | | | |
|---|---|---|---|
| 1,909,332 | 5/1933 | Blackburn . | |
| 3,065,452 | 11/1962 | Osborn | 339/274 |
| 3,924,920 | 12/1975 | Mascioni et al. | 339/246 |
| 4,114,977 | 9/1978 | Polidori | 439/807 |
| 4,279,461 | 7/1981 | Bussen et al. | 339/246 |
| 4,415,222 | 11/1983 | Polidori | 439/807 |
| 4,600,264 | 7/1986 | Counsel | 339/247 |
| 4,650,273 | 3/1987 | Roosdorp | 339/247 |
| 4,723,921 | 2/1988 | Pooley | 439/783 |
| 4,734,062 | 3/1988 | Goto | 439/783 |
| 4,857,020 | 8/1989 | Crosby | 439/783 |
| 4,863,403 | 9/1989 | Shannon | 439/807 |
| 4,911,572 | 3/1990 | Williams | 439/791 |
| 4,915,653 | 4/1990 | Mair | 439/781 |
| 5,005,081 | 4/1991 | Counsel et al. | 439/783 |
| 5,152,701 | 10/1992 | Polidori | 439/791 |
| 5,244,422 | 9/1993 | Laricchia | 439/783 |
| 5,320,565 | 6/1994 | Polidori | 439/791 |

*Primary Examiner*—Gary F. Paumen
*Assistant Examiner*—Eugene G. Byrd

[57] ABSTRACT

A method of manufacturing grounding connectors (1) based on a stamping process on progressive tooling which can produce a grounding connector (1) which is lighter, of a reduced size, and is of low manufacturing cost. The wedge type grounding connector (1) comprises a hollow body (2), a wedge (3), a shear-head bolt (4), two nests (5, 6) for grounding cables (7) and rods (8), and a solid fixture block (9). With the exception of the fixture block (9), all components of the grounding connector (1) are light, and of a reduced size since these components of the grounding connector (1) are manufactured by a stamping process.

21 Claims, 3 Drawing Sheets

METHOD OF MANUFACTURING A GROUNDING CONNECTOR AND IMPROVED GROUNDING CONNECTOR

This application is a Continuation of application Ser. No. 08/363,097 filed Dec. 22, 1994, now abandoned.

BACKGROUND OF THE INVENTION

1. Field of the Invention

The present application relates to a method of manufacturing grounding connectors, and to an improved grounding connector manufactured according to the method. More specifically, the present invention relates to a process of manufacturing grounding connectors which produces a grounding connector that is lighter, is of a reduced size, and is of a low manufacturing cost, since the components of the grounding connector are manufactured by a stamping process.

2. Description of the Prior Art

The sophistication and sensitivity of electronic systems and equipment used in telephone companies and in industry, in general, has created a demand for the development of consistent and reliable grounding systems to protect the circuits from electrical surges due to power variations and other causes. Grounding systems provide a path for the transfer of electrical energy, either for intentional or accidental reasons, to the earth thereby protecting electrical equipment.

Therefore, grounding connectors of the wedge-type were developed. The grounding connectors are reliable and require no special installation equipment other than a common socket, ratchet, or impact wrench. The simplicity of the installation eliminates the requirement of special skills, which in turn minimizes application time. Additionally, the grounding connectors of the prior art present the advantage of being applied in virtually all weather conditions and situations.

However, the above-described grounding connectors present the disadvantage of being heavy and non-compact since the grounding connectors are comprised of a strong, solid body of copper alloy which is manufactured by a die-casting process.

Consequently, it is desirable to develop a method of manufacturing grounding connectors, which reduces raw material usage and thus reduces the manufacturing cost of the grounding connectors, thereby permitting the manufacturing of improved grounding connectors, but which are more practical and of a lighter weight.

SUMMARY OF THE INVENTION

The present invention discloses a stamping manufacturing process for wedge-type grounding connectors, and further discloses an improved grounding connector.

The manufacturing process proposed for the manufacturing of grounding connectors of the present invention is based on a stamping process utilizing progressive tooling, i.e., it is based on the entering of raw material, for example a metallic strip, in the tooling wherein all conformation steps of the grounding connectors are performed in a sequential way, inside the progressive tooling. At the end of the process, the grounding connectors come out from the tool entirely finished and ready to be used.

Thus, there is obtained a grounding connector employing less raw material and in a quicker way than the manufacturing process for manufacturing grounding connectors employed in the prior art which uses a die-casting process.

Further, the present invention provides an improved wedge-type grounding connector basically comprised of a body, a wedge, a commercial shear-head bolt, two conductor nests, and a bolt fixture block. The components are lighter, of a reduced size and of a low manufacturing cost since the components of the grounding connector are manufactured by the stamping process described above.

BRIEF DESCRIPTION OF THE DRAWINGS

Additional features of the invention will become apparent and a fuller understanding will be obtained by reading the following detailed description made in connection with the accompanying drawings, wherein.

DETAILED DESCRIPTION OF PREFERRED EMBODIMENT

Figure 1:
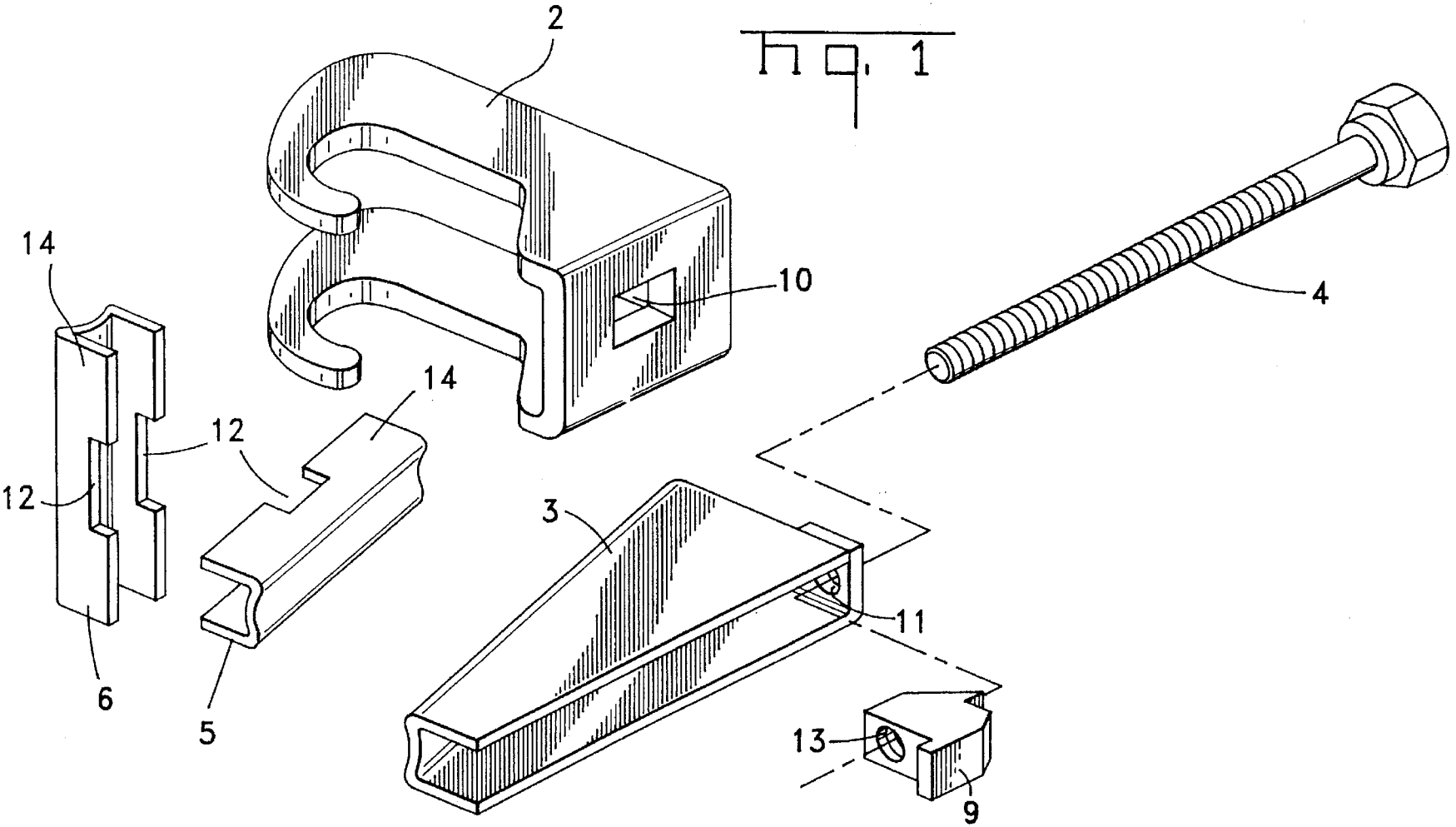
FIG. 1 is an exploded view showing the components of a grounding connector of the present invention.

The improved grounding connector 1 of the present invention, manufactured by a progressive tooling stamping process, is basically comprised of a hollow body 2, a wedge 3, a shear-head bolt 4, two nests 5, 6 for grounding cables 7 and rods 8 and a fixture block 9.

The hollow body 2 of the grounding connector 1 has a general double "J" shape, the two portions in the "J" shape being joined together by one of the ends of the body 2 where a window 10 is found, the window 10 being of a rectangular shape and is designed to receive the fixture block 9.

The wedge 3 has a general trapezoidal shape and is also hollow and has a through hole 11 to receive the shear-head bolt 4. The shear-head bolt 4 used on the present invention is of the same type used on the existent grounding connectors. Nests 5, 6 have general rectangular "U shaped" cutouts 12 in side walls 14, which are designed to accommodate specific wires or a rod size combination.

The fixture block 9 of the present invention is of such a size as to be fit into the rectangular window 10 of the hollow body 2, and, further, a through hole 13 is formed therein to receive the shear-head bolt 4. The function of fixture block 9 is to support the shear-head bolt 4 and to move wedge 3 towards the grounding rod 8 so that it can be pressed against the body 2, nests 5, 6 and the cable 7. The wedge 3 of the grounding connector 1 is pre-assembled on the body 2, by the bolt fixture block 9 and the shear-head bolt 4 before starting the conductor assembly.

Figure 3:
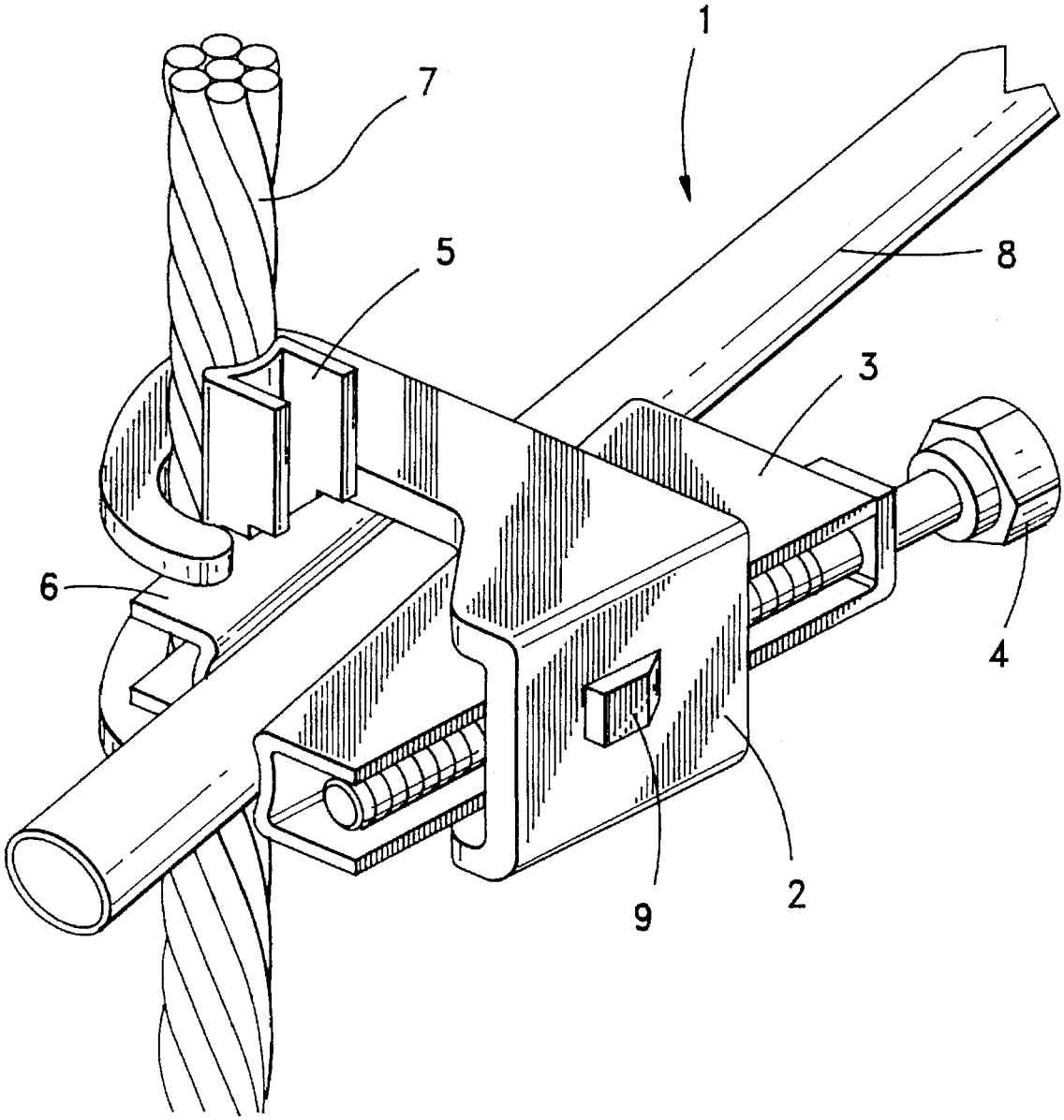
FIG. 3 is a schematic view showing the assembled grounding connector of the present invention.

For application of conductors in the grounding connector 1, it is necessary to manually back out the shear-head bolt 4 until placing wedge 3 against the rod 8; next, cable 7 is pulled into the J-portion of the body 2 of the grounding connector 1 as shown in FIG. 3. Then nests 5, 6 are placed between the two conductors, using the suitable nest sides which are designed to accommodate cable 7 of grounding rod 8. Each nest is designed to accommodate a specific wire or rod size combination.

Figure 2A:
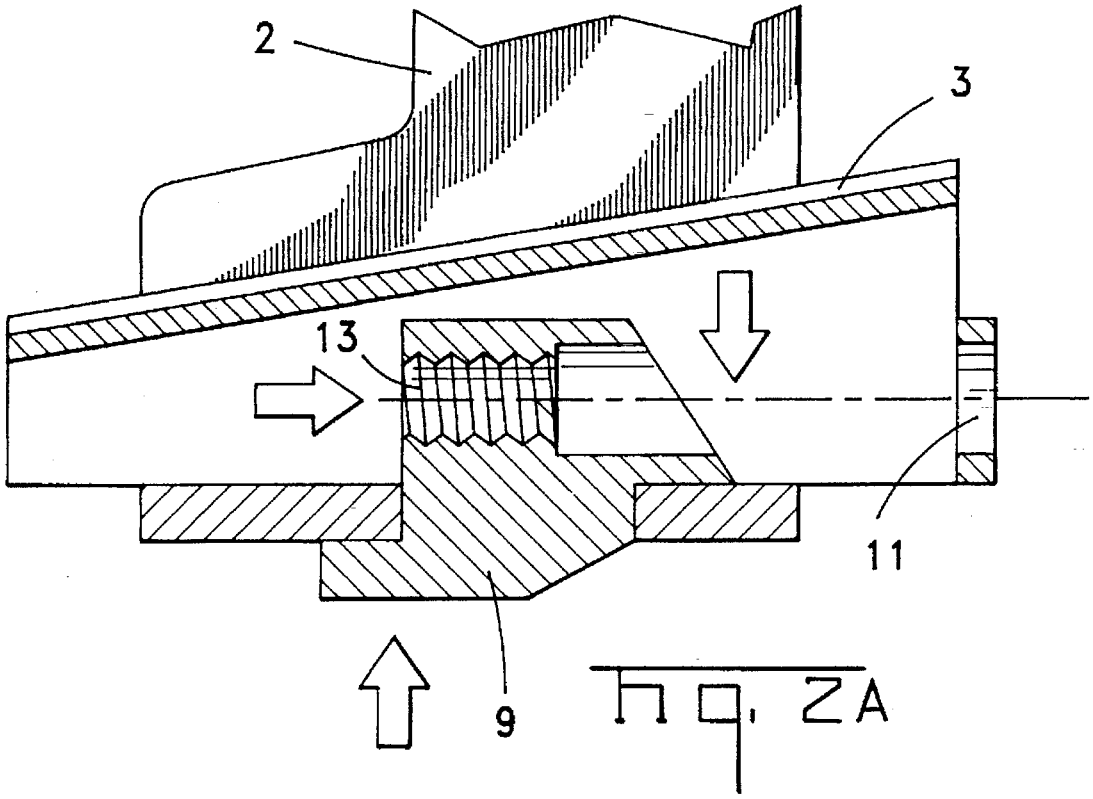
FIGS. 2A and 2B are sectional views showing the assembled grounding connector of FIG. 1.
Figure 2B:
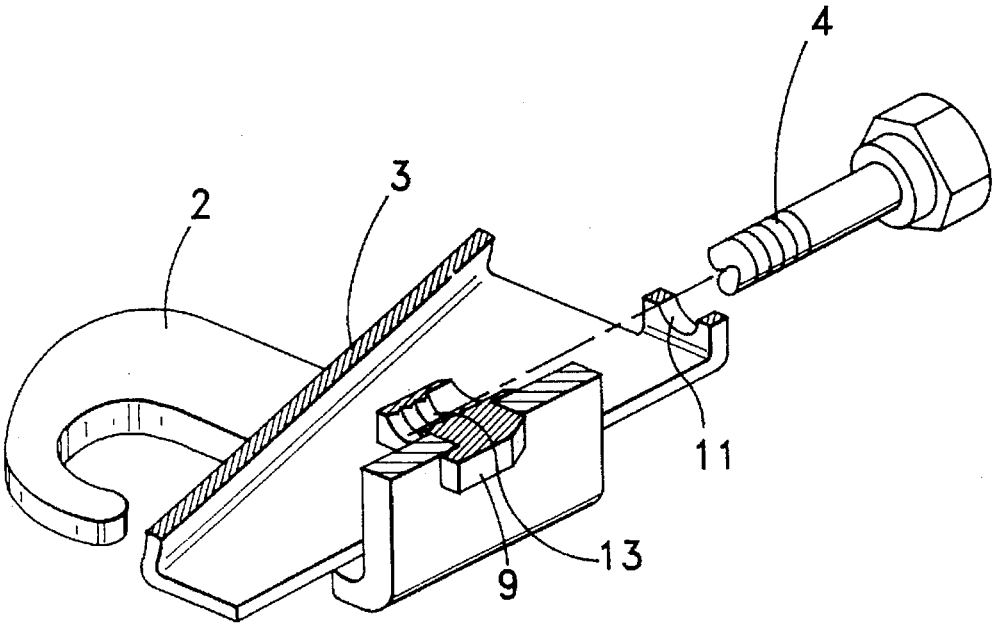

Further, the wedge 3 is pushed into connector 1 and the shear-head bolt is manually pre-tightened. Then, the fixture block 9 of the shear-head bolt 4 will be fixed in the hollow body 2 by the action of opposite reaction forces on the side boarders of the fixture block 9 when the shear-head bolt 4 is tightened, thereby pushing the wedge into the hollow body 2 as shown in FIGS. 2A and 2B.

Finally, using a socket wrench or its equivalent, shear-head bolt 4 is tightened until a specific torque is reached, thus indicating the conclusion of the connection by means of shearing off the bolt head. The taper of wedge 3 forces the body to spring open thereby resulting in a spring action of the body 2 on the grounding rod 8 and cable 7.

Although the invention has been shown and described with respect to a best mode embodiment thereof, it should be understood by those skilled in the art that the foregoing and various other changes, omissions, and additions in the form and detail thereof may be made therein without departing from the spirit and scope of the invention as claimed in the appended claims.

Accordingly, what is claimed is:

1. An electrical connector for use with an electrical circuit, comprising:

a wedge member;

at least one nest member; and a body member having a generally hollow inner portion and a window for receiving a fixture block; and the fixture block is disposed in said window for engaging a tightening bolt.

2. The electrical connector of claim 1, wherein a portion of the fixture block is disposed in said wedge member.

3. The electrical connector of claim 2, wherein a nest is arranged to receive a conductor thereagainst.

4. An electrical connector for use with an electrical circuit, comprising:

a wedge member, a body member having a wedge receiving area, and stamped and formed bent sections for receiving electrical conductors therebetween, a distinct window comprising a window area in communication with said wedge receiving area for receiving a fixture block, and said fixture block and said window are cooperatively shaped to prevent relative movement between said fixture block and said body during use of the connector in the circuit.

5. The electrical connector of claim 4, the wedge member comprises a stamped piece of metal.

6. The electrical connector of claim 4 wherein the fixture block comprises an engaging section for engaging a tightening member.

7. The electrical connector of claim 6, wherein a tightening member engages the fixture block and is activated such that the wedge member is drawn into the body member.

8. An electrical connector for use with an electrical circuit, comprising:

a wedge member, a tightening member, a body member having a generally hollow inner portion for receiving said wedge member, and said wedge member comprises at least one folded section for receiving the tightening member, the folded section comprises an aperture, and the aperture loosely receives the tightening member.

9. The electrical connector of claim 8, wherein the folded section comprises a stamped and formed leg section.

10. The electrical connector of claim 9, wherein a tab extends from said leg section.

11. An electrical connector for use with an electrical circuit, comprising:

a wedge member, a body member having a generally hollow inner portion, and a section for interlocking with a fixture block, said body comprises an aperture with said fixture block partially disposed therein, and said fixture block comprises interlocking sections, said fixture block interlocking sections are operative to transmit forces to said body during use of said connector in the circuit.

12. The electrical connector of claim 11, wherein a tightening member cooperates with said fixture block and is operative to apply forces to said fixture block and said fixture block thereby transmits forces to said body.

13. The electrical connector of claim 11, wherein said fixture block extends through said aperture and is thereby interlocked.

14. An electrical connector for use with an electrical circuit, comprising:

a wedge member, a body member having a generally hollow inner portion and a separate section for receiving a fixture block, and said body hollow portion is defined by hook shaped sections which are folded away from said block receiving section thereby defining formed bends in said body member.

15. The electrical connector of claim 14, wherein said hook sections comprise generally plane shaped sections.

16. The electrical connector of claim 15, wherein said hook sections comprise a space between the plane-shaped sections.

17. The electrical connector of claim 14, wherein said body is a stamped and formed piece made from generally flat metal.

18. The electrical connector of claim 8, wherein the connector comprises a fixture block with an engaging section for engaging the tightening member.

19. The electrical connector of claim 18, wherein the tightening member engages the fixture block and is activated such that the wedge member is drawn into the body member.

20. The electrical connector of claim 11, wherein the fixture block comprises an engaging section for engaging the tightening member.

21. The electrical connector of claim 20, wherein the tightening member engages the fixture block and is activated such that the wedge member is drawn into the body member and the fixture block transmits forces to said body member.

* * * * *